US009101938B2

(12) United States Patent
Becker et al.

(10) Patent No.: US 9,101,938 B2
(45) Date of Patent: Aug. 11, 2015

(54) PRE-GRINDER OR PRE-SHREDDER

(76) Inventors: Arnaud Becker, Rosheim (FR); Caroline Becker, Rosheim (FR); Catherine Becker, Theoule sur Mer (FR)

( * ) Notice: Subject to any disclaimer, the term of this patent is extended or adjusted under 35 U.S.C. 154(b) by 429 days.

(21) Appl. No.: 13/979,479

(22) PCT Filed: Jan. 12, 2011

(86) PCT No.: PCT/FR2011/050057

§ 371 (c)(1),
(2), (4) Date: Aug. 2, 2013

(87) PCT Pub. No.: WO2011/086326

PCT Pub. Date: Jul. 21, 2011

(65) Prior Publication Data

US 2013/0306767 A1 Nov. 21, 2013

(30) Foreign Application Priority Data

Jan. 12, 2010 (FR) ..... 10 50184
May 18, 2010 (FR) ..... 10 53811

(51) Int. Cl.

| | |
|---|---|
| ***B02C 18/06*** | (2006.01) |
| ***B02C 18/24*** | (2006.01) |
| ***B02C 13/286*** | (2006.01) |
| ***B02C 13/30*** | (2006.01) |

(Continued)

(52) U.S. Cl.

CPC ..... *B02C 18/24* (2013.01); *B02C 13/20* (2013.01); *B02C 13/286* (2013.01); *B02C 13/30* (2013.01); *B02C 4/42* (2013.01); *B02C 2018/307* (2013.01)

(58) Field of Classification Search

CPC ..... B02C 18/24; B02C 4/42
USPC ..... 241/236, 101.2, 185.1
See application file for complete search history.

(56) References Cited

U.S. PATENT DOCUMENTS 3,545,690 A 12/1970 Burian et al.
4,046,324 A * 9/1977 Chambers ..... 241/46.06

(Continued)

FOREIGN PATENT DOCUMENTS

DE 197 08 185 9/1998
FR 2 431 326 2/1980

(Continued)

OTHER PUBLICATIONS

International Search Report dated Jun. 9, 2011, corresponding to PCT/FR2011/050057.

*Primary Examiner* — Faye Francis
(74) *Attorney, Agent, or Firm* — Young & Thompson

(57) ABSTRACT

A pre-grinder or pre-shredder apparatus, essentially made up of at least one drive unit (1) including a hydraulically or electrically driven motor (2), a reduction gear (3) and at least one shredding element (4) connected thereto and mounted on a frame (5), a wall, a feeder chute or any other mounting. The reduction gear (3) of the drive unit (1) of the pre-grinder or pre-shredder forms an element for attaching and supporting at least one shredder element (4) and is made up of a stationary portion (3'), attached directly to the frame (5) of the pre-grinder or pre-shredder or on a mounting or a wall of the latter, and by a mobile portion (3"), the shredder element (4) being inserted on the mobile portion of the reduction gear. The apparatus is useful in treating materials from any source, in particular by shredding using grinders, hammer mills or similar devices.

30 Claims, 5 Drawing Sheets

(51) Int. Cl.

| | |
|---|---|
| ***B02C 13/20*** | (2006.01) |
| *B02C 4/42* | (2006.01) |
| *B02C 18/30* | (2006.01) |

(56) References Cited

U.S. PATENT DOCUMENTS

| | | | | |
|---|---|---|---|---|
| 4,905,910 | A | 3/1990 | Wuestner | |
| 7,014,133 | B2 * | 3/2006 | Ho | 241/36 |
| 2005/0161541 | A1 * | 7/2005 | Lo | 241/236 |

FOREIGN PATENT DOCUMENTS

| | | |
|---|---|---|
| FR | 2 620 651 | 3/1989 |
| FR | 2 670 133 | 6/1992 |
| WO | 01/85346 | 11/2001 |

* cited by examiner

PRE-GRINDER OR PRE-SHREDDER

BACKGROUND OF THE INVENTION

1. Field of the Invention

This invention relates to the field of processing materials of all origins, in particular by shredding by means of crushers or of hammer mills, or the like, and has as its object a pre-grinder or pre-shredder.

2. Description of the Related Art

The recovery of metal products from objects that are unserviceable, in particular motor vehicles, by means of crushers or grinders, is generally performed by introducing the objects in a hammer mill, via an introduction ramp equipped with a crushing drum; said hammer mill pulls and shreds the material entering there, by interaction with one or more anvils, which eject and/or evacuate, through screening walls, the mechanical scraps obtained that exhibit a determined size. These scraps are then processed for the purpose of eliminating materials that are unsuitable for reuse and for the purpose of sorting the remaining materials as a function of their metallurgical characteristics.

The processing of very bulky objects or materials necessitates the use of grinders or crushers of large size and high power and therefore with a very high production cost as well as a very high cost of use.

Thus, it has been proposed to use pre-grinders or pre-shredders that make possible a size reduction and fractionation of the very bulky objects and materials, so as to increase the density thereof for the purpose of transporting them, storing them, or burying them, or else processing them in more compact grinders, crushers or granulating machines whose feed openings are of a smaller cross-section.

The pre-grinders or pre-shredders that exist today are, nevertheless, also of large size and high power, generally consisting of one or more slow rotation rotors, which turn in the same or opposite direction.

These rotors shred the material under the interaction of the tools that equip them, and the speed of rotation of the rotors can be identical or different from one rotor to the next. The shafts of these rotors are driven by electric or hydraulic motors, either directly or by means of reducing gears.

In the particular case of pre-shredders or of pre-grinders of automobile bodies, the pre-shredding shafts most often number two, exhibit a large diameter, namely on the order of 500 to 600 millimeters, each weigh nearly 10 tons, and each require a power on the order of 250 Kw to drive them. The length of the line of shafts of such machines is generally between 4 meters and 5 meters, and even more, for a useful working width on the order of 2 meters.

Furthermore, the shredding tools are mounted generally by welding on the large cross-section drive shaft and are therefore not interchangeable. The driving of these shafts, which are mounted at their ends in large cross-section roller bearings, which rest on the lateral walls of the shredder, is performed by motor and reduction gear assemblies, which are fastened laterally on both sides of the housing of these machines or of their feeding chute.

The mounting of these large-sized pieces of equipment, namely reducing gears and motors, outside of these machines has as a result a considerable space requirement of the latter, which is incompatible with a small-capacity processing unit, which must, in essence, be mobile for its possible use on different sites.

Moreover, the motors used are most often hydraulic motors, which are slow, very heavy and mounted freely on the ends of the shafts, or even electric or hydraulic motors connected to said shafts by ordinary reducing gears or planetary gears. Furthermore, in all cases, the drive shafts must be held by bearings equipped with rings or roller bearings, the power or drive elements not being carriers and resting on the ends of these shafts or being fastened to a frame or walls of the machine.

The making of such grinders or pre-shredders is very expensive, and the machines made in this way are very bulky and very heavy.

Furthermore, by WO-A-0185346, a grinding device is known that consists, on the one hand, of a drive assembly and, on the other hand, of a grinding chamber connected in a removable way to the drive assembly, the rotors of the grinding chamber being connected to the drive assembly by means of end-plates or collars. Of course, such a device makes it possible to solve partially the problem of service actions, but necessitates the use of complete sub-assemblies, any action on a grinding chamber entailing the complete disassembly of the latter and its replacement with an identical chamber, no element of the drive sub-assembly making it possible to ensure a direct function for guiding or support of a rotor shaft, for example.

In effect, the shafts of the rotors are mounted on specific roller bearings, their guiding being ensured in a totally autonomous way by their drive assembly. Consequently, using such a device is very expensive necessitating, in fact, the provision of complete, interchangeable grinding chambers, the service actions then being performed in idle time.

By FR-A-2 431 326, a grinder rotor mounting is also known in which the cylinder forming the rotor is integral with the rotor of an electric motor, whose stator is fastened to a through shaft that simultaneously forms the bearing of the cylinder forming the rotor. Such an embodiment obviously makes it possible to reduce the bulk of the rotor assembly of the grinder and drive motor, but necessitates significant and costly disassembly work that is incompatible with the making of low-cost grinders or pre-grinders that are quick and simple to use.

SUMMARY OF THE INVENTION

This invention has as its object to eliminate these drawbacks by proposing a pre-grinder or pre-shredder that makes it possible to solve the problems of bulk and of weight and that makes possible an adaptation to different processing capacities, while having a simple make-up and a low production cost.

For this purpose, the pre-grinder or pre-shredder according to the invention, which essentially consists of at least one drive assembly comprising a hydraulic or electric drive motor and a reducing gear and of at least one shredding assembly connected to the reducing gear, is characterized in that the reducing gear of the drive assembly forms an element for fastening and support of at least one shredding element and consists of a stationary part, fastened directly to the frame of the pre-grinder or pre-shredder or to a support or a wall of the latter, and of a mobile part, the shredding element being fitted to the mobile part of this reducing gear.

BRIEF DESCRIPTION OF THE DRAWING FIGURES

The invention will be better understood thanks to the following description that is related to preferred embodiments, given by way of nonlimiting examples, and explained with reference to the accompanying diagrammatic drawings, in which.

DETAILED DESCRIPTION OF THE INVENTION

Figure 1:
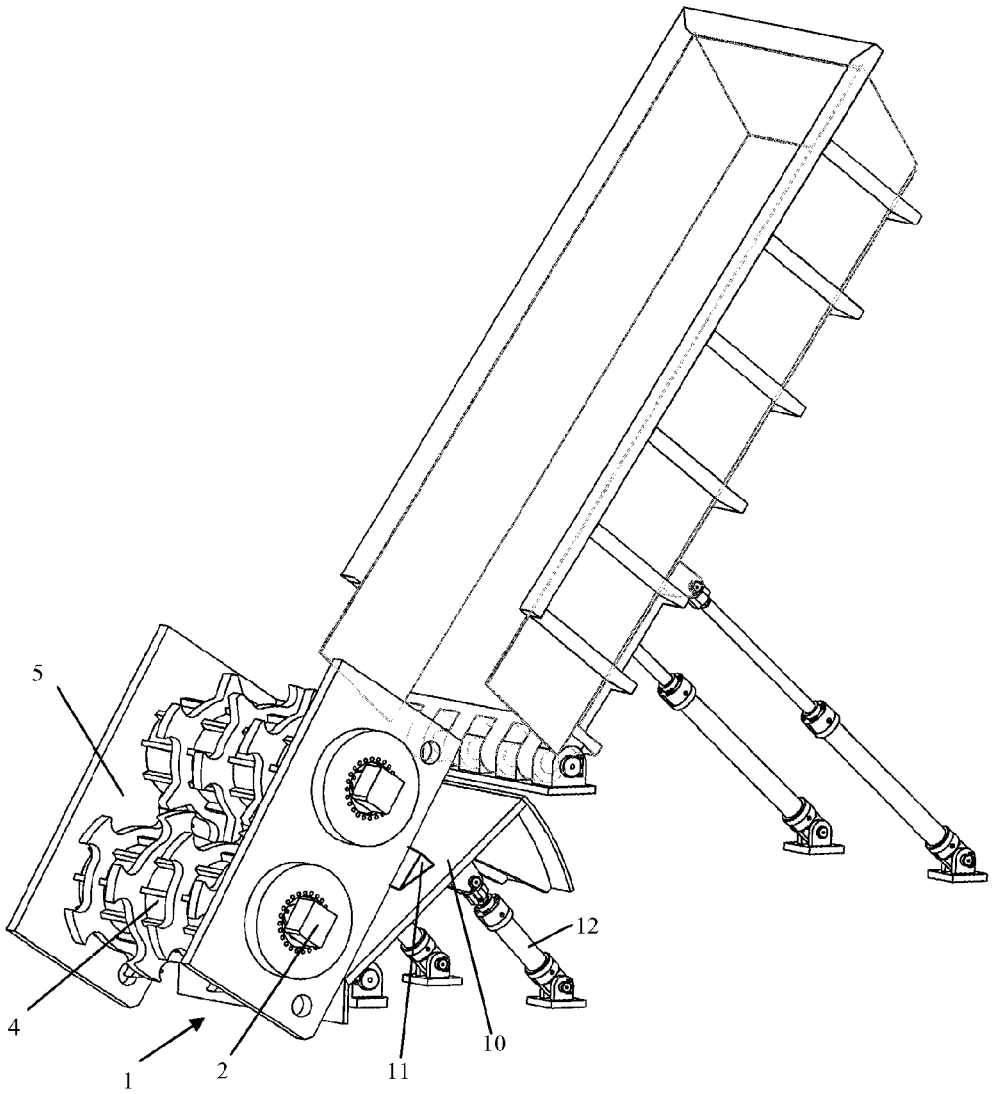
FIG. 1 is a view in perspective of a pre-grinder or pre-shredder according to the invention.

FIG. 1 of the accompanying drawings shows, by way of example, a pre-grinder or pre-shredder intended to be used in the field of the processing of materials of all origins, in particular by shredding by means of crushers or of hammer mills, or the like.

Such a pre-grinder or pre-shredder essentially consists of at least one drive assembly 1 comprising a hydraulic or electric drive motor 2 and a reducing gear 3 and of at least one shredding element 4 connected to the reducing gear 3, and is mounted on a frame 5, a feeding chute or another support (FIG. 1). In a known way, such a pre-grinder or pre-shredder can be mounted upstream from a crusher or grinder and feeds directly, at its output, said crusher or grinder.

According to the invention, the reducing gear 3 of the drive assembly 1 of this pre-grinder or pre-shredder forms a fastening and support element of at least one shredding element 4, and consists of a stationary part 3', fastened directly to the frame 5 of the pre-grinder or pre-shredder or to a support or a wall of the latter, and of a mobile part 3", the shredding element 4 being fitted to the mobile part 3" of this reducing gear 3. Thus, the shredding element 4 is guided and held directly on the frame 5 by the reducing gear 3 of the drive assembly 1. Consequently, it is said drive assembly 1 comprising the motor 2 and the reducing gear 3 that ensures the functions of support and of guiding in rotation of the shredding element 4, so that the invention makes it possible to achieve the savings of individual bearings or journal bearings for said shredding element 4, which entails a simplification of the mounting and a reduction in costs.

Figure 2:
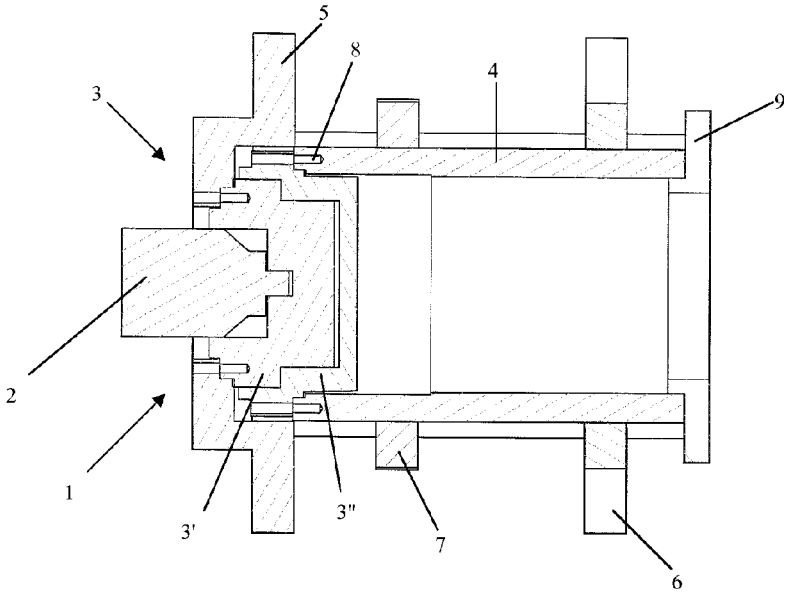
FIG. 2 is a partial plan view in section showing a first embodiment of a pre-grinder or pre-shredder according to the invention.
Figure 3:
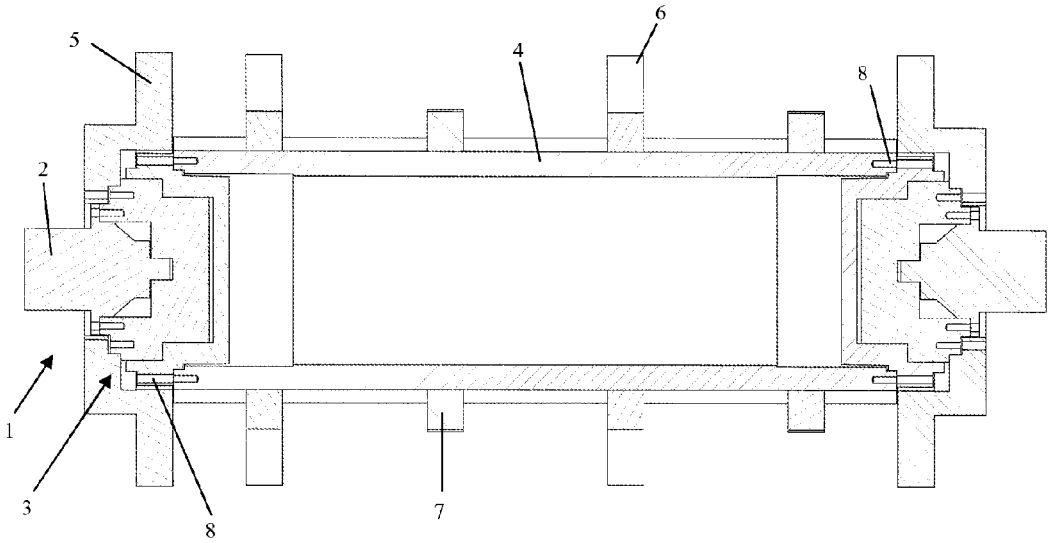
FIG. 3 is a view similar to the one of FIG. 2 of a variant embodiment of the invention.

According to a first embodiment of the invention, the shredding element 4 is a tube having a wall with a large cross-section, fitted by one end on the reducing gear 3 (FIGS. 2 and 3). This shredding element 4 can, in particular, be in the form of an interchangeable part that is subject to wear and tear.

It is also possible, according to another embodiment of the invention, not shown in the accompanying drawings, to make the shredding element 4 in the form of a solid shaft equipped at at least one end with a housing intended for its fitting on the reducing gear 3.

The reducing gear 3 of the drive assembly 1 is a device known in the art, comparable to the known mechanisms under the name translation reducing gears, of very compact design, and making it possible to transmit very high torques at reduced speeds, while guaranteeing a perfect adaptation of the speed to the reduction ratios.

According to a characteristic of the invention, the reducing gear 3 of the drive assembly 1, which essentially consists of a stationary part 3' and of a mobile part 3", is advantageously fastened to the frame 5 of the pre-grinder or pre-shredder or to a wall or other element of the latter by means of the stationary part 3', on which is mounted the motor 2 that can be of hydraulic or electric type. Preferably, the motor 2 will be a hydraulic motor. Such an attachment of the reducing gear 3 can be performed, in an ordinary manner, by means of bolts, locking pins, screws or the like. Thus, the shredding element 4 and the drive assembly 1 can be mounted on the frame 5, a wall or another element of the machine without using a smooth bearing or a roller bearing, the function of bearings for support and guiding being ensured directly by the drive assembly 1 and, in particular, by the reducing gear 3. A considerable simplification results of the mounting of the shredding element 4 in relation to the devices known to date, particularly by WO-A-0185346 and by FR-A-2 431 326, and in particular in terms of production costs.

According to a characteristic of the invention, the mobile part 3" of the reducing gear 3 is mounted overhanging the frame 5 or wall, etc., in relation to the stationary part 3' of this reducing gear and forms a fastening support of the shredding element 4. In the case of using a tube having a wall with a large cross-section, this tube has a wall thickness that is sufficient to withstand forces and is equipped, either directly by welding with shredding tools 6, or by means of at least one collar 7, forming a tool-holder, with stationary or mobile shredding tools that are interchangeable. In this way, the shredding tools mounted on such a collar 7 are very easily disassembled and can therefore be changed as simple parts that are subject to wear and tear.

Furthermore, because of this overhanging mounting of the reducing gear 3 (FIG. 2) or the mounting of the reducing gear 3 on each side of the frame 5 (FIG. 3), the invention makes it possible to avoid the provision of specific bearings for the shredding elements 4, the reducing gear or reducing gears 3 directly ensuring this function of holding and roller bearings. The shredding element 4 according to the invention is thus, in fact, a simple interchangeable part that necessitates no specific mounting on roller or holding bearings during a replacement, before their connection to the reducing gear 3.

Actually, by their mounting on the mobile part 3" of the reducing gear or reducing gears 3, the shredding elements 4 are directly mounted on parts that ensure their support and their guiding in rotation.

According to a variant embodiment of the invention, not shown in the accompanying drawings, the stationary parts 3' of the reducing gears 3 can be mounted on eccentric collars that work with reaction arms or the like. It is thus possible to cause the space between two elements 4 to vary.

In the embodiment shown in FIG. 2 of the accompanying drawings, the pre-grinder or pre-shredder consists simply of a drive assembly 1 comprising a hydraulic or electric drive motor 2 and a reducing gear 3 and of a shredding element 4 formed by a tube having a wall with a large cross-section, equipped with shredding tools. In such a case, the shredding assembly works in the shredding chamber, overhanging in relation to the frame 5 or to a wall, by being simply supported by the reducing gear 3. It is also possible to mount, between the mobile part 3" of the reducing gear 3 and the shredding element 4, a tool-holding assembly for grinding or for shredding in the form of end-plates equipped with mobile or stationary peripheral tools.

According to another variant embodiment of the invention, the shredding element 4 is advantageously fastened to the mobile part 3" of the reducing gear 3 by means of pins or screws 8 and is equipped at its opposite end with a sealing cover (not shown) or with an assembling collar 9, fastened by screwing, by bolting or by welding. The provision of an assembling collar 9 makes possible the juxtaposition of a shredding element 4 mounted on one side of a frame or on one wall with a second shredding element 4 mounted on the opposite side of the frame or on the opposite wall, the free ends of each shredding element then being connected to one another by bolting or by an assembling by cooperation of shape. Such a bolting comes under a standard assembly in the field of mechanics and simply uses bolts that pass through two adjacent collars 9 and is therefore neither described nor shown in greater detail. The same holds true in the case of an assembling by cooperation of shape that can be of the jaw-teeth type or the like.

Thus, two shredding elements 4, juxtaposed and joined by their free end, make it possible to obtain a shredding machine that has double the power of that of a single unit and that therefore makes it possible to process more voluminous parts.

Because the collar 9 or the cover are fastened to the hollow tube forming the shredding element 4 in a removable way, the adaptation of said element 4 to different embodiments can be performed quickly and without difficulty.

Also, mounting two pre-grinders or pre-shredders in a juxtaposed manner can be foreseen, without them being connected to one another, so that their operation can be totally independent.

In the case of using a cover on the free end of the shredding element 4, it is possible to fill the space delimited between the mobile part 3" of the reducing gear 3 and said cover with a cooling liquid. Such a cooling liquid makes it possible to use the shredding element 4 as a radiator. Actually, during operation, the reducing gear 3 is subjected to a high elevation of temperature, which could be detrimental to a long-term operation, so that its cooling must be ensured. The provision of cooling liquid in the interior space of the hollow tube forming the shredding element 4 makes it possible to ensure a considerable absorption of the heat energy released and, because the grinder or crusher is subjected, in a known way, to a strong suction of air through its feed opening, the air passing through the latter passes previously over the shredding element 4 and cools the latter, which has the effect of a corresponding cooling of the cooling liquid contained in the latter and therefore of the reducing gear 3.

It is also possible to mount several shredding elements 4 in series between two reducing gears 3 so as to obtain a very large working width. Of course, in such a case, it will be advisable to select drive assemblies 1, as well as supports 5 of the latter, sized accordingly. In such a case, it is also possible to place, between the shredding elements 4 in series, grinding or shredding tool-holding assemblies in the form of end-plates equipped with mobile or stationary peripheral tools. Thus, the used tools of these assemblies can be easily and quickly interchanged by disassembly and reassembly of entire sub-assemblies.

According to a variant embodiment of the invention, in the case of using two shredding elements connected by their free ends by means of collars 9, these collars 9 can advantageously be provided with sealing means. Thus, the interior space delimited in the assembled elements 4 can also be used as a reservoir for cooling liquid.

FIG. 3 of the accompanying drawings shows a variant embodiment of the invention, in which the pre-grinder or pre-shredder comprises two drive assemblies 1, placed in opposition on a frame 5 or on a support or a wall of the latter, these drive assemblies 1 working with a single shredding element 4 in the form of a tube having a wall with a large cross-section or of a solid shaft equipped at its ends with housings intended for its fitting on the reducing gears 3, fitted at each of its ends on the mobile part 3" of the reducing gears 3. Such an embodiment makes it possible to obtain pre-grinders or pre-shredders whose working width is comparable to that of the traditional pre-grinders or pre-shredders, while having a bulk and weight that are very clearly smaller and a production cost that is also clearly lower.

In the embodiment of the invention according to FIG. 1 of the accompanying drawings, the pre-grinder or pre-shredder comprises two drive assemblies 1 each equipped with at least one shredding element 4, these drive assemblies and shredding element 4 being mounted in parallel to work by their tools 6 being interlocked or not, the shredding elements 4 being able to be driven in rotation in the same or opposite direction.

Finally, according to another characteristic of the invention and as FIG. 1 of the accompanying drawings shows, to improve the working of the pre-grinder or pre-shredder, the latter can have a mobile flap 10 equipped with teeth 11 that form obstacles between the tools 6 of the shredding element 4, said mobile flap 10 being mounted in a pivoting manner under or on said pre-grinder or pre-shredder and controlled in pivoting by means of at least one jack 12. Thus, the feeding of the pre-grinder or pre-shredder can be significantly improved by the possibility of direct intervention on the material to be processed, in particular to facilitate its progression into the machine or to perform an unclogging.

Preferably, in the case of using shredding elements 4 mounted at their two ends on reducing gears 3, whose stationary parts 3' are each fastened to a wall of the frame 5 of the pre-grinder or pre-shredder, a stationary part 3' of one end of each shredding element 4 is mounted on the corresponding wall of the frame 5 by interlocking with a collar or a ring, not shown, sliding in a corresponding bearing of said corresponding wall of the frame 5 and held against a rotation, while the stationary part 3' assigned at the opposite end is advantageously directly interlocked with the corresponding wall. Thus, it is possible to ensure the free expansion of the shaft of each shredding element 4.

The hold against a rotation of the sliding collars or rings interlocked with the stationary part 3' is ensured by means of cotter pins (not shown) that work with corresponding longitudinal grooves provided in the bearings provided in the wall of the frame 5, as well as on said sliding collars or rings, or even by means of a reaction arm connecting said collars or rings each to a stationary point provided on said wall of the frame 5. Such a reaction arm, which consists of a rod or the like connected by its ends, respectively, to the corresponding collar or ring and to the frame 5 or to a wall of the latter, is of a type known in the art and does not require additional description. Thus, a freedom of translation of the sliding collar or ring is allowed, its rotation remaining impossible because of its attachment to the wall of the frame 5 or to the frame 5 by means of the reaction arm.

Figure 4:
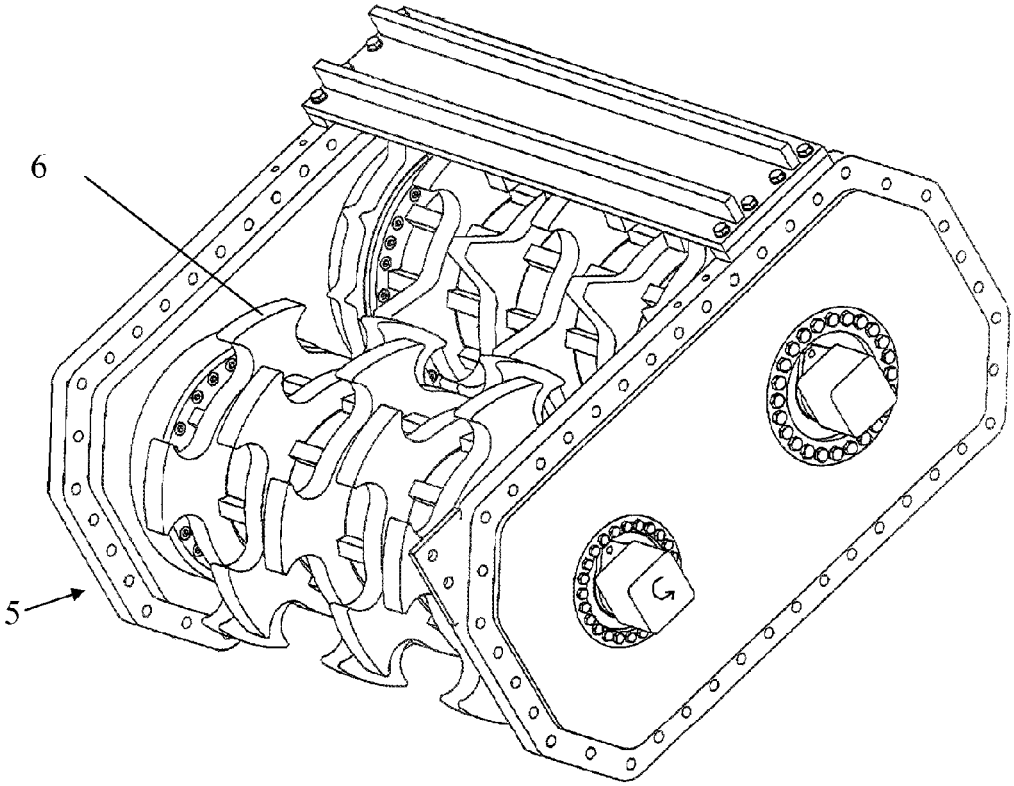
FIG. 4 is a partial view on a larger scale, similar to the one of FIG. 1, showing the pre-grinder or pre-shredder.

FIG. 4 of the accompanying drawings shows a variant embodiment of the invention, in which the walls of the frame 5 forming the supports of the shredding elements 4 are advantageously mounted in a reversible way with the side walls of the frame 5 on the support of said frame 5, so as to make possible a turning-over of these elements 4 with the walls of the frame 5, around an axis that is perpendicular to their longitudinal axis. For this purpose, the walls 5 are machined and exhibit fastening means so that they can be mounted on the support of frame 5, both by their lower edge and by their upper edge.

Preferably, the shredding tools 6 that equip each shredding element 4 are in the form of double-faced tools or have two opposite active faces.

Thus, after a disassembly of the side walls of support of the elements 4 of the frame 5, it is possible to perform a turning-over of the assembly of the parts connected to the elements 4, so as to achieve a reversed mounting of said elements 4 and of their drive means, so that the side of the tools 6 that is not yet used can be put into use.

According to another characteristic of the invention, not shown in the accompanying drawings, each side wall of the support frame 5 of the shredding elements 4 can be subdivided into a number of plates equal to the number of shredding elements 4, each plate being assigned to the support and guiding of one end of a shredding element 4 and being connected to the neighboring plate or plates, as well as to the rest of the frame 5 by means of an assembly means by bolting or the like. Thus, it is possible to perform an individual turning-over of each shredding element 4, independently of the neighboring element 4, as described above.

According to another characteristic of the invention, in the case of using side walls of frame 5 that are subdivided into several plates, each equipped with a reducing gear 3, mounted overhanging, with a shredding element 4, by means of its stationary part 3', on such a plate, at least one thus equipped plate can be mounted in an articulated way or to slide in relation to the neighboring plate and can be actuated by a jack in the direction of a pivoting or of a sliding upward in relation to said neighboring plate. Preferably, such a plate that is articulated with the shredding element 4 will be placed upstream from the other plates, namely at the intake of a pre-grinder or pre-shredder in the direction of a feeding chute. Thus, it is possible to disengage a first shredding element 4 at the intake of a pre-grinding or pre-shredding machine, so as to enable the introduction into this machine of relatively bulky products, for example having a size greater than the width of a shredding element 4, these products then being crushed during the return to the position of the element 4 by flipping over or sliding into service position of the pivoting plate supporting it.

Figure 5:
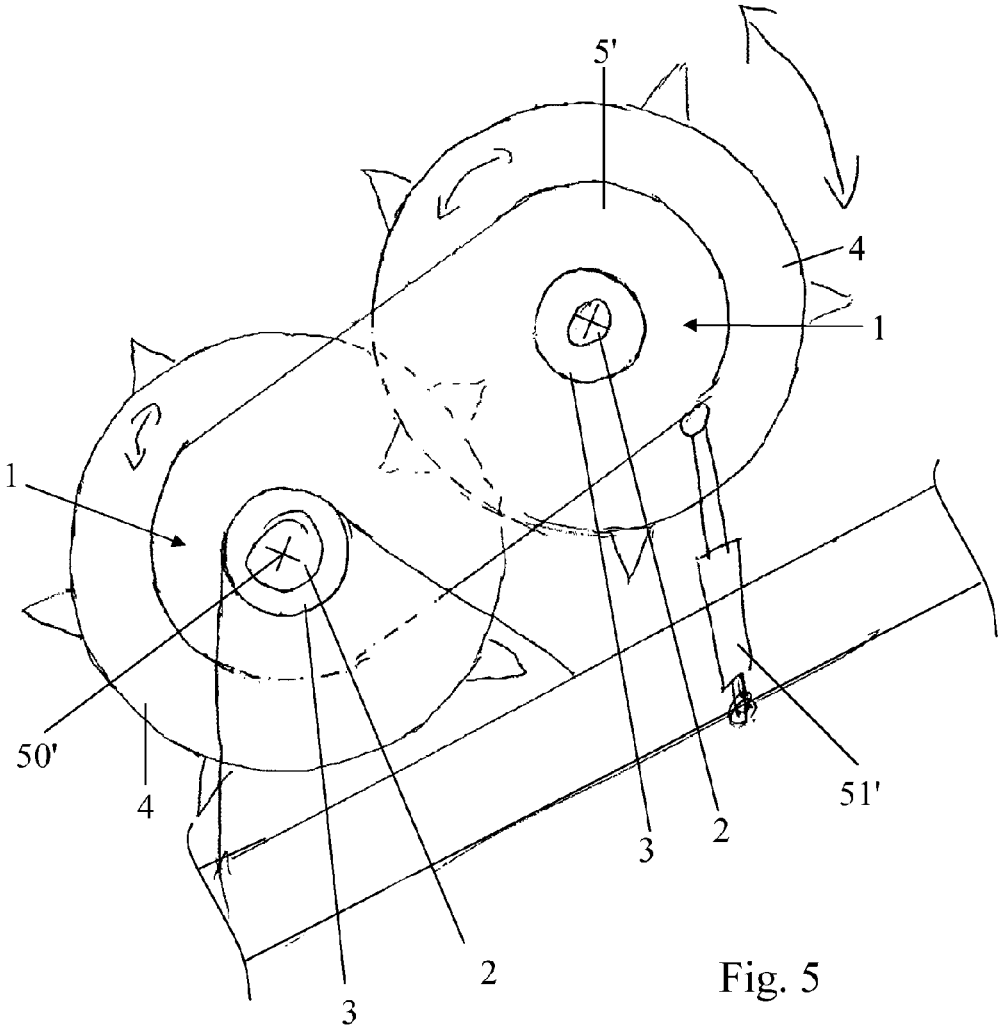
FIG. 5 is a view in side elevation of a variant embodiment of the pre-grinder or pre-shredder according to FIGS. 1 and 4.

FIG. 5 of the accompanying drawings shows a variant embodiment of the invention, in which the pre-grinder or pre-shredder comprises at least one shredding element 4 driven by a drive assembly 1, this shredding element 4 being mounted on the end of a frame 5' in the form of a pair of support arms, whose other end is articulated on the frame of a grinder or on a feed ramp or the like by means of a shaft 50', this frame 5' being able to be pivoted around the shaft 50' by at least one jack 51'. Thus, it is possible to cause the distance to vary of the shredding element 4 in relation to a feed ramp or to a feed hopper, such that the pre-grinding or pre-shredding can be more or less significant, for example as a function of the mechanical strength of the products to be ground.

According to a characteristic of the invention, the shredding element 4 can be single and work with stationary counter-tools or, as FIG. 5 shows, can work with an identical shredding element 4 having an identical or different direction and speed of rotation, the shaft of this second shredding element being able to simultaneously form the pivoting shaft 50' of the frame 5' or an eccentric pivoting shaft of the frame 5.

In the case of a different speed of rotation and of a rotation in the same direction, it will be possible to feed directly a grinder or a crusher, this while improving the pre-grinding or pre-shredding, which will facilitate the grinding and crushing operation.

The counter-tools that work optionally with the shredding element 4 can be in the form of stationary or removable tools that are interlocked with mobile supports under the action of a jack, so that said tools can be retracted to make possible a direct ejection or a direct feeding of a downstream grinder.

The provision of a device according to FIG. 5 and the resulting method of operation make it possible to eliminate a flap or a feed roll or a crusher of products to be treated, which entails a savings of weight on the assembly of the equipped machine and a corresponding savings as regards its cost.

The shredding element 4 provided at the pivoting end of the frame 5' has the same effect as a flap or a crusher because it compresses the material against a wall preferably of the feed ramp and, because of the pivoting movement of the frame 5', it makes it possible to cause the material to be processed to advance toward stationary counter-tools or toward the other shredder element 4. Preferably, the regulating of the application pressure of the shredding element 4, mounted to pivot on the frame 5' and actuated by the jack or jacks 51', will be performed in such a way that the maximum drive torque of the shredding element 4 is virtually reached, so that on reaching this maximum torque, a managing automatic control system will automatically cause a pivoting of the frame 5' in the opposite direction.

In the case where the elements 4 turn in the opposite direction, all of the shredding forces are concentrated between the two elements 4 and on the articulation means, namely the frame 5' of the shredding element 4 mounted to pivot in relation to the shaft 50'. The result is a significant lightening of the carrying structure of the unit.

Finally, according to another characteristic of the invention, not shown in the accompanying drawings, a part of the feed ramp, preferably located under the shredding element 4 mounted to pivot in relation to the shaft 50', is articulated to serve as a flap for ejection of products that cannot be shredded or cannot be ground, this pivoting part of the feed ramp being actuated by jacks, preferably hydraulic jacks.

Figure 6:
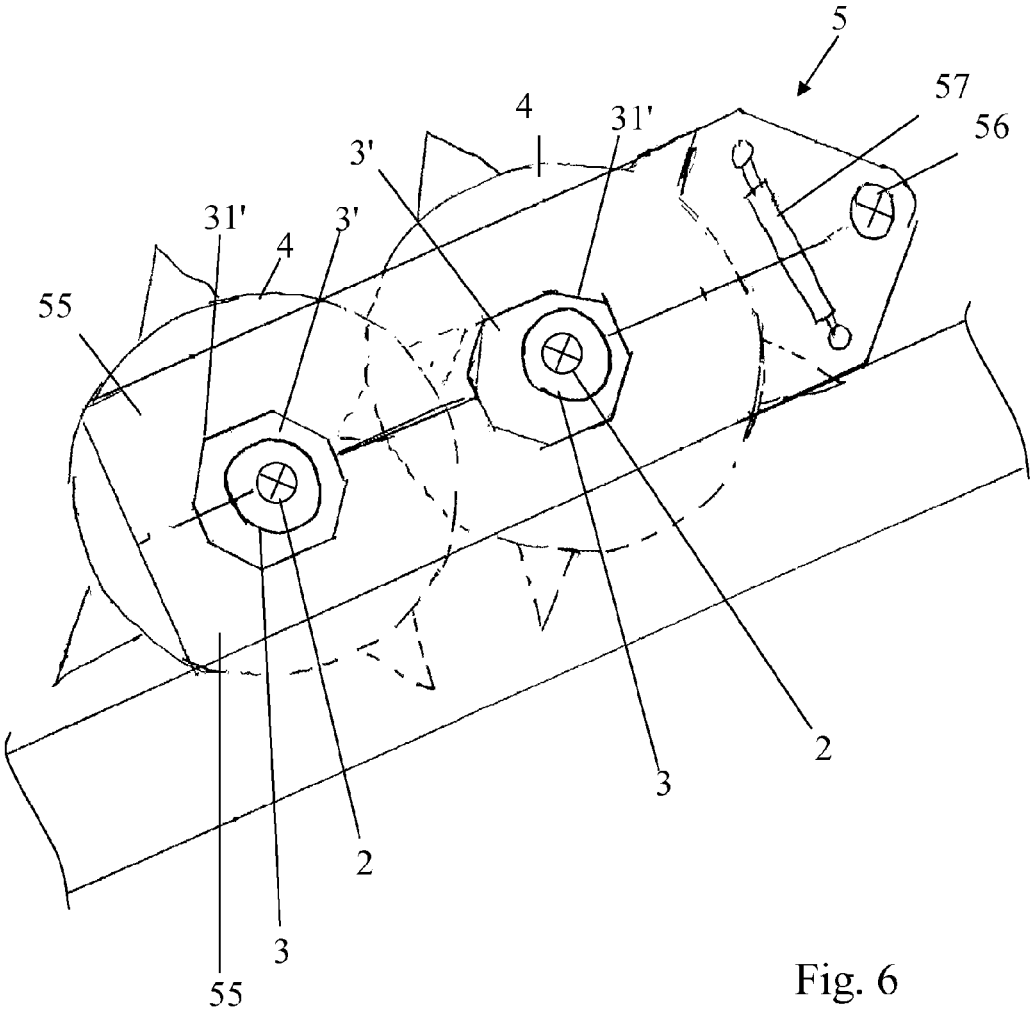
FIG. 6 is a view similar to the one of FIG. 5 of another variant embodiment of the invention.

According to another characteristic of the invention and as FIG. 6 of the accompanying drawings shows, the side walls of frame 5 can advantageously be subdivided into two symmetrical parts 55 along the axis line connecting the shafts of the reducing gears 3 and of the shredding elements 4 and thus form at the level of each of these shafts half-bearings for receiving the stationary parts 3' of said reducing gears 3, the two parts 55 of the frame 5 being connected to one another at one of their ends by an articulation shaft 56 and that can be pivoted in relation to one another around this shaft 56 by means of at least one actuation jack 57. Such an embodiment makes it possible to initiate a quick assembly and disassembly of the reducing gear 3—shredding element(s) 4 assemblies, by simple pivoting of one part 55 of the wall of the frame 5 in relation to the other, so that the stationary parts 3' of the reducing gears 3 can be instantly held or disengaged.

Preferably, in such a case, the bearings 31' of the stationary parts 3' of the reducing gears 3, as well as said stationary parts 3' can advantageously exhibit a non-circular cylindrical cross-section, namely oval or polygonal (FIG. 6), so that the holding of said stationary parts 3' of the reducing gears 3 against a rotation is ensured automatically. The result is that the bearings can simultaneously ensure a movement of the stationary parts 3', due to the expansion of the shredding element or elements 4, the limitation of this expansion movement of the stationary parts 3' being ensured by the provision on the latter, on both sides of the side wall of corresponding frame 5, of an inserted stop (not shown).

According to another characteristic of the invention, also shown in FIG. 6 of the accompanying drawings, it is also possible to mount the stationary parts 3' of the reducing gears 3 in an eccentric way in non-circular cylindrical bearings. Thus, each shredding element 4 with its drive assembly 1 can be position-adjusted in the frame 5 by a simple rotation around the mounting shaft on the walls of the frame 5, which will have the effect of causing a movement of the shredding elements 4 in the direction of an approach or of a separation parallel to the bottom of the feed ramp or to a neighboring shredding element 4.

Finally, the pre-grinder or pre-shredder according to the invention can be equipped with a removable or articulated protective hood that extends, in service position, above the shredding element or elements 4 and is connected to the upper part of the side walls of the support frame 5 of said element or elements 4 by an articulation shaft or by means for fastening by bolting or the like.

Such a protective hood is not shown in the accompanying drawings for reasons of simplification of the latter, its make-up and its method of mounting being completely accessible to a person skilled in the art.

Thanks to the invention, it is possible to make a pre-grinder or pre-shredder of products to be processed that is of small bulk and of reduced weight. Furthermore, because of the use of the reducing gear 3, the design of such machines is also considerably simplified and therefore clearly less costly.

In addition, the possibility of a mounting of the shredding elements in two directions makes possible the use of double-faced tools and thus the obtaining of an increased service life of the parts that are subject to wear and tear.

Of course, the invention is not limited to the embodiments described and shown in the accompanying drawings. Modifications remain possible from the standpoint of the make-up of the various elements or by substitution of technical equivalents, without thereby exceeding the scope of protection of the invention.

The invention claimed is:

1. A pre-grinder or pre-shredder, consisting of:

at least one drive assembly formed from a hydraulic or electric drive motor and a reducing gear;

at least one shredding element connected to the reducing gear;

a support on which the at least one shredding element is mounted; and an element for fastening and support of the at least one shredding element, the element being formed from the reducing gear and having a stationary part fastened directly to the support, and the element having a mobile part to which the shredding element is fitted.

2. The pre-grinder or pre-shredder, according to claim 1, wherein the shredding element is guided and held directly on the support by the reducing gear of the drive assembly, which ensures the functions of support and of guiding in rotation of the shredding element.

3. The pre-grinder or pre-shredder, according to claim 1, wherein the shredding element is a tube having a wall with a large cross-section fitted by one end on the reducing gear.

4. The pre-grinder or pre-shredder, according to claim 1, wherein the shredding element is a solid shaft equipped at at least one end with a housing intended for its fitting on the reducing gear.

5. The pre-grinder or pre-shredder, according to claim 1, wherein the shredding element is an interchangeable part that is subject to wear and tear.

6. The pre-grinder or pre-shredder, according to claim 1, wherein the reducing gear, is fastened to the support by the stationary part, on which is mounted the hydraulic or electric drive motor.

7. The pre-grinder or pre-shredder, according to claim 1, wherein the mobile part is mounted overhanging the support in relation to the stationary part and forms a fastening support of the shredding element.

8. The pre-grinder or pre-shredder, according to claim 1, wherein the shredding element is equipped, either directly by welding with shredding tools, or by means of at least one collar forming a tool-holder, with stationary or mobile shredding tools that are interchangeable.

9. Pre-grinder or pre-shredder, according to claim 1, wherein there are a plurality of reducing gears, and the stationary parts of the reducing gears are mounted on eccentric collars that work with reaction arms.

10. The pre-grinder or pre-shredder, according to claim 1, wherein a hollow tube forming the shredding element is fastened to the mobile part of the reducing gear by means of pins or screws and is equipped at an opposite end with a sealing cover or with an assembling collar, fastened by screwing, by bolting or by welding.

11. The pre-grinder or pre-shredder, according to claim 1, wherein several shredding elements are mounted in series between two reducing gears, so as to obtain a very large working width.

12. The pre-grinder or pre-shredder, according to claim 11, wherein grinding or shredding tool-holder assemblies, in a form of end-plates equipped with mobile or stationary peripheral tools, are placed in series between the shredding elements.

13. The pre-grinder or pre-shredder, according to claim 1, wherein a space delimited between the mobile part of the reducing gear and a cover on the free end of the shredding element or between two reducing gears is filled with a cooling liquid.

14. The pre-grinder or pre-shredder, according to claim 1, further comprising two drive assemblies, placed in opposition on the support or a wall of the support, the drive assemblies working with a single shredding element in a form of a tube having a wall with a large cross-section or of a solid shaft having ends equipped with housings intended for fitting on the reducing gears, fitted at each of ends on the mobile part of a reducing gear.

15. The pre-grinder or pre-shredder, according to claim 1, further comprising two drive assemblies each equipped with at least one shredding element, the drive assemblies and shredding element being mounted in parallel to work by their tools being interlocked or not, the shredding elements being able to be driven in rotation in a same or opposite direction.

16. The pre-grinder or pre-shredder, according to claim 1, further comprising a mobile flap equipped with teeth that constitute obstacles between the tools of the shredding element, said mobile flap being mounted in a pivoting manner under or on said pre-grinder or pre-shredder and controlled in pivoting by at least one jack.

17. The pre-grinder or pre-shredder, according to claim 1, wherein in the case of using shredding elements mounted at their two ends on reducing gears, whose stationary parts are each fastened to a wall of the support of the pre-grinder or pre-shredder, a stationary part of one end of each shredding element is mounted on the corresponding wall of the support by interlocking with a collar or a ring sliding in a corresponding bearing of said corresponding wall of the support and held against a rotation, while the stationary part assigned at the opposite end is directly interlocked with the corresponding wall.

18. The pre-grinder or pre-shredder, according to claim 17, wherein a hold against a rotation of the sliding collars or rings that are interlocked with the stationary part is ensured by cotter pins that work with corresponding longitudinal grooves provided in the bearings made in the wall of the support, on said sliding collars or rings, or by a reaction arm connecting said collars or rings each to a stationary point provided on said support.

19. The pre-grinder or pre-shredder, according to claim 1, wherein walls of the support are mounted in a reversible way with the side walls of the support on the support side of said support, so as to make possible a turning-over of these elements with the walls of the support, around an axis that is perpendicular to their longitudinal axis.

20. The pre-grinder or pre-shredder, according to claim 1, wherein shredding tools that equip each shredding element are in a form of double-faced tools or have two opposite active faces.

21. The pre-grinder or pre-shredder, according to claim 1, wherein each side wall of the support is subdivided into a number of plates equal to the number of shredding elements, each plate being assigned to the support and guiding of one end of the shredding element and being connected to the neighboring plate or plates, as well as to the rest of the frame by bolting.

22. The pre-grinder or pre-shredder, according to claim 21, wherein in the case of using side walls of the support that are subdivided into several plates, each equipped with a reducing gear, mounted overhanging, with the shredding element, by means of the stationary part, on such a plate, at least one plate that is thus equipped is mounted in an articulated way or to slide in relation to the neighboring plate and is actuated by a jack in the direction of a pivoting or of a sliding upward in relation to said neighboring plate.

23. The pre-grinder or pre-shredder, according to claim 1, comprising at least one shredding element driven by a drive assembly, a shredding element being mounted on the end of a frame in a form of a pair of support arms, whose other end is articulated on the frame of a grinder or on a feed ramp or the like by a shaft, the frame being able to be pivoted around the shaft by at least one jack.

24. The pre-grinder or pre-shredder, according to claim 23, wherein the shredding element is single and works with stationary counter-tools or is a first shredding element that works with an identical second shredding element having an identical or different direction and speed of rotation, a shaft of this second shredding element being able to simultaneously form the pivoting shaft of the frame or an eccentric pivoting shaft of the support.

25. The pre-grinder or pre-shredder, according to claim 23, wherein a part of the feed ramp, located under the shredding element mounted to pivot in relation to the shaft, is articulated to serve as a flap for ejection of products that cannot be shredded or cannot be ground, this pivoting part of the feed ramp being actuated by jacks.

26. The pre-grinder or pre-shredder, according to claim 1, wherein side walls of the support are subdivided into two symmetrical parts along the axis line connecting the shafts of the reducing gears and of the shredding elements and thus form, at a level of each of these shafts, half-bearings for receiving the stationary parts of said reducing gears, the two parts of the support being connected to one another at one of their ends by an articulation shaft and are pivoted in relation to one another around this shaft by at least one actuation jack.

27. The pre-grinder or pre-shredder, according to claim 26, wherein bearings of the stationary parts of the reducing gears as well as said stationary parts exhibit a non-circular cylindrical cross-section which is oval or polygonal, so that holding of said stationary parts of the reducing gears against a rotation is ensured automatically.

28. The pre-grinder or pre-shredder, according to claim 27, wherein limitation of expansion movement of the stationary parts is ensured by the provision on the stationary parts, on both sides of the side wall of the corresponding support, of an inserted stop.

29. The pre-grinder or pre-shredder, according to claim 26, wherein the stationary parts of the reducing gears are mounted in an eccentric way in non-circular cylindrical bearings.

30. The pre-grinder or pre-shredder, according to claim 1, wherein it is equipped with a removable or articulated protective hood that extends, in service position, above the shredding element or elements and is connected to an upper part of side walls of the support of said element or elements by an articulation shaft or by bolts.

* * * * *